United States Patent [19]

Holmstrom

[11] Patent Number: 4,694,646

[45] Date of Patent: Sep. 22, 1987

[54] EXHAUST PORT EQUALIZER DEVICE

[76] Inventor: Robert P. Holmstrom, 30427 Nye, Livonia, Mich. 48484

[21] Appl. No.: 871,787

[22] Filed: Jun. 9, 1986

[51] Int. Cl.[4] ..... F01N 3/00

[52] U.S. Cl. ..... 60/272; 123/193 H

[58] Field of Search ..... 60/272; 123/193 H

[56] References Cited

U.S. PATENT DOCUMENTS 3,958,418 5/1976 Heidacker ..... 60/272

4,302,935 12/1981 Cousimano ..... 60/272

*Primary Examiner*—Douglas Hart

*Attorney, Agent, or Firm*—Reising, Ethington, Barnard, Perry & Milton

[57] ABSTRACT

An exhaust port equalizer device 30 for insertion into an exhaust port-passage 12 of the head of an internal combustion engine. The device is detachably clamped between the head and an exhaust header 24 in communication with the exhaust port passage 12. The device 30 comprises a plate-like body of substantially uniform thickness; it is a sheet metal stamping.

9 Claims, 3 Drawing Figures

EXHAUST PORT EQUALIZER DEVICE

TECHNICAL FIELD

This invention relates to devices for smoothing air flow in exhaust port-passages of internal combustion engines in automobiles.

BACKGROUND ART

The power of an internal combustion engine is effected by the efficiency of the flow of exhaust gases through the exhaust port. An original factory port of an internal combustion engine is a basic approximation of the most desirable configuration for the flow of the exhaust gases. Frequently, engines are manufactured with exhaust port-passages that contain sharp bends and turns and abrupt changes in cross-sections that create stagnation areas. This results in decreased engine performance.

One approach to this problem has been to fill the stagnation areas by depositing metal in these stagnation areas through welding to reduce the actual cross-section area and improve the air flow. This method, however, is costly and cracking sometimes occurs in the weld area.

Another approach to this problem is disclosed in Cousimano U.S. Pat. No. 4,302,935. The Cousimano patent discloses a thick wedge-shaped insert of arcuate cross-section with upwardly curved margins that are installed by welding the insert onto a header plate engine prior to the securement of a header tube to the engine head. The header tube is then permanently welded to the header plate. Once the header plate and insert is welded to the header tube, it cannot be removed from the header tube.

STATEMENT OF THE INVENTION AND ADVANTAGES

An exhaust port equalizer device having a sheet metal body of substantially uniform thickness with a support portion clamped between the engine head and a header tube communicating with an exhaust port passage in the engine head. The device includes a flow control portion that extends into and defines one side portion of the port-passage. The flow control portion projects at an angle from and smothes the air flow between the port-passage and the exhaust header tube.

Other objects, advantages and features of the invention will become apparent from the following description taken in connection with the accompanying drawings.

DESCRIPTION OF THE PREFERRED EMBODIMENT

Figure 1:
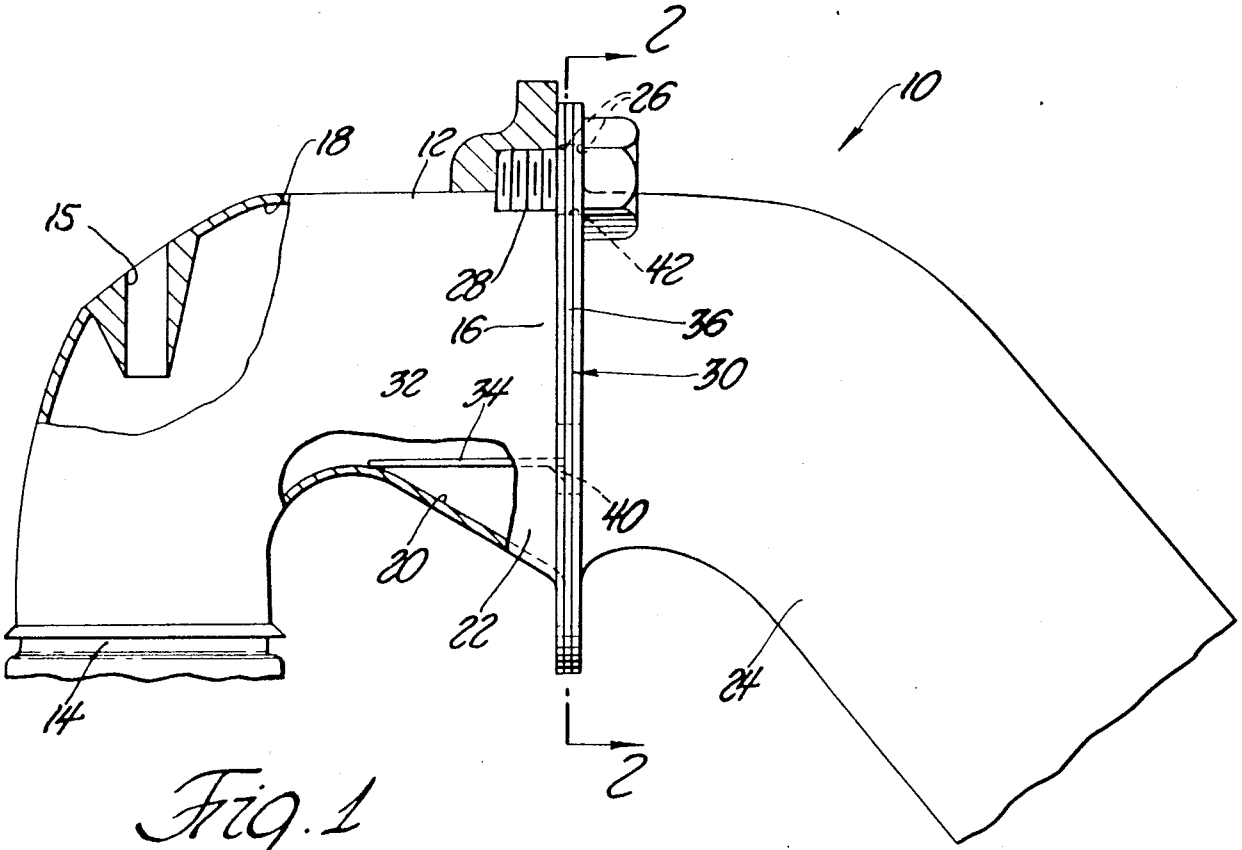
FIG. 1 is an elevational view of a portion of an internal combustion engine head equipped with an exhaust port equalizer device embodying the invention, with portions broken away.

In FIG. 1, reference numeral 10 collectively designates an internal combustion engine head and exhaust header tube assembly. The assembly 10 includes a pipe-like member in which an exhaust port-passage 12 of an internal combustion engine head is formed. The exhaust port-passage 12 includes an exhaust inlet 14 and an outlet 16 with a straight wall 18 at the exhaust port 16 and an inclined wall 20 directly opposite the straight wall 18. The inlet 14 is controlled by a conventional poppet valve (not shown) having a stem slidable in opening 15. The exhaust gases from the engine enter the inlet 14 and flow to the outlet 16. As a result of the abruptly enlarged cross-section defined by the inclined wall 20, a stagnation area 22 for exhaust gases exists.

The assembly 10 further includes an exhaust header 24 connected to the port-passage member 12. The exhaust header 24 and port-passage member 12 include aligned openings 26. A threaded fastener 28 is disposed in the openings 26 and threadedly engage a tapped hole in the port-passage member 12 to secure the header 24 to the port-passage member 12.

The assembly 10 includes a sheet metal exhaust port equalizer device, collectively indicated by reference numeral 30, removably clamped between the exhaust header 24 and the port-passage member 12 to smooth the air flow between the port-passage 12 and the exhaust header 24. The device 30 has an integral plate-like body; it is preferably of stamped sheet metal.

The device 30 includes a flow control portion 32 for extending into and defining one side portion of the port-passage 12. The flow control portion 22 has an exterior 34 substantially parallel to the side portion 18 directly opposite of the flow control portion 32. The flow control portion 32 extends into the stagnation area 22 of the port-passage 12 to provide an exhaust port restriction at the exhaust port 16.

The device 30 further includes a support portion 36 connected to the flow control portion 32 for removable attachment between the exhaust header 24 and the port-passage 12. The flow control portion 32 is substantially flat and perpendicular to the support portion 36. The flow control portion 32 extends substantiaively perpendicularly to the support portion 36 to present an exterior 34 of the flow control portion 32 substantially parallel to the side portion 18 of the port-passage 12.

Figure 2:
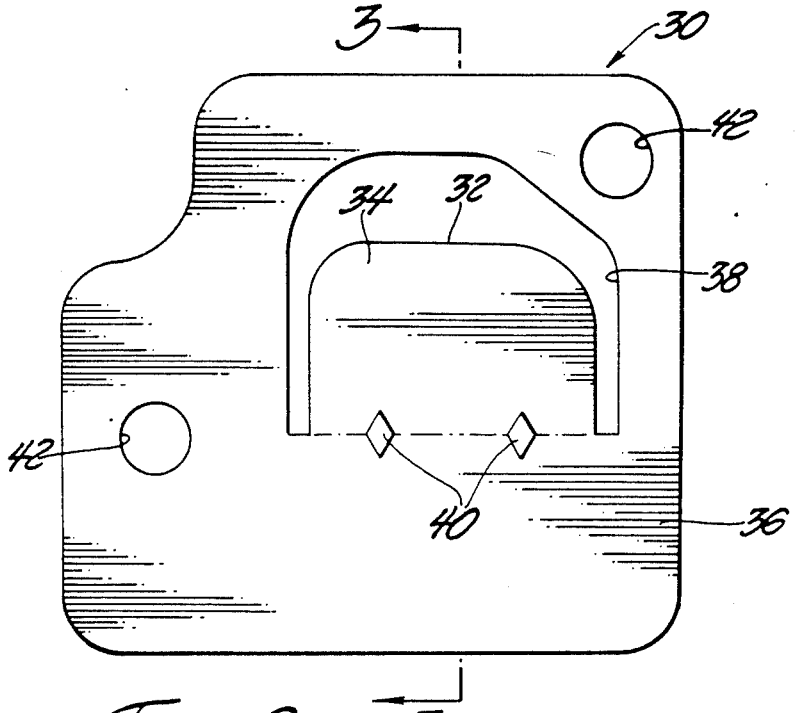
FIG. 2 is a plan view of the exhaust port equalizer device of FIG. 1.
Figure 3:
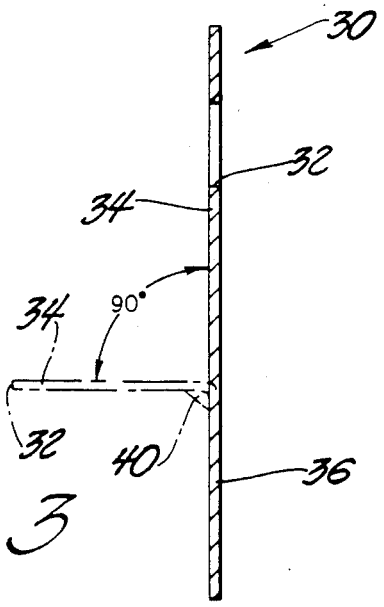
FIG. 3 is a sectional view taken along lines 3—3 of FIG. 2.

As illustrated in FIG. 2, the support portion 36 includes an aperture 38 substantially coexistensive to the peripheral configuration of the exhaust port-passage 12; the aperture 38 is substantially the same diametrical configuration of the exhaust port-passage 12 such that the opening interconnects the flow control portion 34 and the side portion 18 of the exhaust port-passage 12. Hence, the exhaust port 16 will be reduced in cross-section since a portion of the support portion 36 will close, restrict, or obstruct a portion of the exhaust port 16.

The device 30 further includes ribs 40 at the intersection of the flow control portion 32 and the support portion 36 to strengthen the intersection. The ribs 40 are produced by indentations at the intersection to provide support between the support portion 36 and the flow control portion 32.

The support portion 36 includes openings 42 to receive the fasteners 28 and allow the attachment of the support portion 36 between the port-passage 12 and the exhaust header 24. The openings 42 having the same location as the openings 26 of the exhaust header 24 and port-passage 12 to allow the device 30 to be removably attached or sandwiched therebetween without altering either the exhaust header 24 or the port-passage 12.

The device 30 is installed by removing the fastener 28 from the openings 26 of the exhaust header 24 and port-passage 12 and placing the device 30 between the exhaust header 24 and port-passage 12 such that the flow control portion 32 extends into and defines one side portion of the port-passage 12 and the support portion 36 connected to the flow control portion 32 is adjacent to and abuts the port-passage 12. The fastener 28 is then installed in the bores 26 and openings 42 to removably secure the device 30 between the exhaust header 24 and the port-passage 12.

While a specific form of the invention is described in the foregoing specification and illustrated in the accompanying drawings, it should be understood that the invention is not limited to the exact construction shown. Alternatives and variations in the construction and arrangement of parts, all falling within the scope of the claims, will be apparent to those skilled in the art.

What is claimed is:

1. An exhaust port equalizer device (30) for insertion into an exhaust port-passage (12) of an internal combustion engine having an exhaust header (24) connected to the exhaust port-passage (12), said device (30) comprising: an integral sheet metal body of substantially uniform thickness having a flow control portion (32) for extending into and defining one side portion (18) of the port-passage (12), and a support portion (36) connected to said flow control portion (32) for removable attachment between the exhaust header (24) and the port-passage (12) to smooth the gas flow between the exhaust port-passage (12) and the exhaust header (24), said flow control portion (32) being substantially flat and projecting at an angle from said support portion (36).

2. A device as claimed in claim 1 further characterized by said support portion (36) including an aperture (38) substantially coextensive to the peripheral configuration of the exhaust port-passage (12).

3. A device as claimed in claim 2 including ribs (40) at the intersection of said flow control portion (32) and said support portion (36) to strengthen said intersection.

4. A device as claimed in claim 3 further characterized by said support portion (36) including openings 42 to receive fasteners (28) and allow attachment of said support portion (36) between the exhaust port-passage (12) and exhaust header (24).

5. A device as claimed in claims 2, 3 or 4 further characterized by said flow control portion (32) projecting perpendicularly from said support portion (36).

6. An exhaust port equalizer assembly (10) comprising: an exhaust port-pipe (12) of an internal combustion engine, an exhaust header (24) connected to said exhaust port-pipe (12), a sheet metal exhaust port equalizer device (30) including a flow control portion (32) extending into and defining one side portion (18) of said port-passage (12), and a support portion (36) connected to said flow control portion (32) removably attached between said exhaust port-passage (12) and said exhaust header (24) to smooth the gas flow between said exhaust port-passage (12) and said exhaust header (24).

7. An assembly as claimed in claim 6 further characterized by said flow control portion (32) being substantially flat and perpendicular to said support portion (36).

8. An assembly as claimed in claim 7 further characterized by said support portion (36) including an aperture (38) substantially coextensive to the peripheral configuration of said exhaust port-passage (12).

9. An assembly as claimed in claim 8 including ribs (40) at the intersection of said flow control portion (32) and said support portion (36) to strengthen said intersection.

* * * * *